US006056559A

United States Patent [19]

Olson

[11] Patent Number: 6,056,559

[45] Date of Patent: May 2, 2000

[54] PUNCHED SHEET COAX HEADER

[75] Inventor: Stanley W. Olson, East Berlin, Pa.

[73] Assignee: BERG Technology, Inc., Reno, Nev.

[21] Appl. No.: 08/942,082

[22] Filed: Oct. 1, 1997

[51] Int. Cl.[7] ..... H01R 13/648

[52] U.S. Cl. ..... 439/108; 439/607

[58] Field of Search ..... 439/108, 92, 78, 439/109, 607–610, 55, 63, 750, 101, 931, 581, 578

[56] References Cited

U.S. PATENT DOCUMENTS

| | | | |
|---|---|---|---|
| 3,435,387 | 3/1969 | Reinke et al. | 333/79 |
| 3,587,028 | 6/1971 | Uberbacher | 339/14 |
| 4,020,430 | 4/1977 | Ernest et al. | 333/79 |
| 4,046,445 | 9/1977 | Anhalt | 339/95 |
| 4,296,990 | 10/1981 | Stowers et al. | 339/128 |
| 4,606,598 | 8/1986 | Drzymkowski et al. | 339/147 R |
| 4,749,355 | 6/1988 | Hemmer | 439/63 |
| 5,169,343 | 12/1992 | Andrews | 439/608 |
| 5,174,770 | 12/1992 | Sasaki et al. | 439/108 |
| 5,194,020 | 3/1993 | Voltz | 439/579 |
| 5,198,958 | 3/1993 | Krantz, Jr. | 361/119 |
| 5,257,949 | 11/1993 | Paulus | 439/620 |
| 5,344,340 | 9/1994 | Houleau | 439/581 |
| 5,516,307 | 5/1996 | Cartesse et al. | 439/581 |
| 5,562,462 | 10/1996 | Matsuba et al. | 439/70 |
| 5,577,935 | 11/1996 | Harting et al. | 439/581 |
| 5,624,278 | 4/1997 | Kuroda et al. | 439/675 |
| 5,795,191 | 8/1998 | Preputnik et al. | 439/108 |

*Primary Examiner*—Paula Bradley
*Assistant Examiner*—Alexander Gilman
*Attorney, Agent, or Firm*—Woodcock Washburn Kurtz Mackiewicz & Norris LLP

[57] ABSTRACT

A connector having a conductive ground plate having first and second faces, in which first protrusions protrude from the first face, and second protrusions protrude from the second face. The second protrusions are hollow and form a raised ground surface. An insulator element having a pinhole is disposed around the inner surface of the second protrusions. A signal pin extends through the pinhole in the insulator element and through the conductive ground plate and is separated from the conductive ground plate by the insulator element, and the raised ground surface surrounds the insulator element and the signal pin.

26 Claims, 13 Drawing Sheets

PUNCHED SHEET COAX HEADER

FIELD OF THE INVENTION

The present invention relates in general to electrical connectors. More particularly, the present invention relates to a connector assembly for use in connection with circuit boards. Even more particularly, the present invention relates to a connector assembly for providing electrical interconnection between two printed circuit boards or the like.

BACKGROUND OF THE INVENTION

In electronic equipment, there is a need for electrical connectors providing connections in signal paths, and often the signal paths are so closely spaced that difficulties arise from interference between signals being transmitted along adjacent paths.

As a general matter, many types of connectors are not well suited for preventing electrical interference or crosstalk between adjacent signal connections. As the signal speed becomes higher and the signal connections located closer to one another, this interference or crosstalk becomes even more problematic. This concern with electrical interference or crosstalk also arises in other contexts such as, for example, when one printed circuit board (e.g., a daughterboard) is mounted on another printed circuit board (e.g., a motherboard) and in the case of fast clock speed or high speed data transmission.

Thus, in high speed backplane applications, low crosstalk between signal currents passing through the connector is desirable. Additionally, maximizing signal density is also desirable. Low crosstalk allows the electronics to switch at higher frequencies without problems. High density increases the number of circuits that can be routed through the connector.

Although the art of connector assemblies is well developed, there remain some problems inherent in this technology, particularly electrical interference and crosstalk between adjacent signal connections. Therefore, a need exists for a connector assembly that is well suited for preventing interference or crosstalk between adjacent signal connections.

SUMMARY OF THE INVENTION

The present invention is directed to a connector comprising a conductive ground plate having first and second faces, a plurality of first protrusions protruding from the first face, and a plurality of second protrusions protruding from the second face, the second protrusions being hollow and forming respective raised ground surfaces; a plurality of insulator elements, each being disposed around the inner surface of the second protrusions, and having a pinhole; a plurality of signal pins, one signal pin extending through each of the pinholes in the insulator elements and through the conductive ground plate and separated from the conductive ground plate by the insulator elements, and one of the raised ground surfaces surrounding respective insulator elements and signal pins.

In the present invention, the second protrusions are substantially cylindrical and are drawn. Each of the second protrusions have a top surface and a lower surface, the top surfaces being disposed in a first common plane, and the lower surfaces being disposed in a second common plane.

In a further embodiment within the scope of the present invention, a connector system for mounting to a circuit substrate comprises a housing and a connector module supported by the housing. The connector module includes a conductive ground plate having first and second faces, a plurality of first protrusions protruding from the first face, and a plurality of second protrusions protruding from the second face, the second protrusions being hollow and forming a raised ground surface; a plurality of insulator elements, each respective insulator element having a pinhole disposed around the inner surface of each of the second protrusions; a plurality of signal pins, one of the signal pins extending through respective ones of the pinholes in the insulator elements and through the conductive ground plate and separated from the conductive ground plate by the insulator elements, and one of the raised ground surfaces surrounding respective insulator elements and signal pins; and a plurality of socket connectors, each having a plurality of signal receptacle contacts and a plurality of ground receptacle contacts, so that, in mated condition, each respective signal contact mechanically connects and electrically contacts with each respective signal pin, and each of the ground contacts mechanically connects and electrically contacts with respective raised ground surfaces.

Another embodiment within the scope of this invention includes each socket connector comprising a receptacle housing, and each socket connector is a right angle type of socket connector, each signal receptacle contact is a single cantilevered signal receptacle contact, and each ground receptacle contact is a dual cantilevered ground receptacle contact.

Another embodiment within the scope of this invention includes each socket connector comprising a receptacle housing, and each socket connector is a right angle type of socket connector, each signal receptacle contact is a tuning fork style signal contact, and each ground receptacle contact is a dual cantilevered ground receptacle contact.

The foregoing and other aspects of the present invention will become apparent from the following detailed description of the invention when considered in conjunction with the accompanying drawing.

DESCRIPTION OF EXEMPLARY EMBODIMENTS AND BEST MODE

The present invention is directed to a coaxial style backplane header connector and socket receptacle connector. The present invention uses a coax style extruded plate as a central element. A mating connector employs a strip line construction for reduced crosstalk and controlled impedance.

Figure 1B:
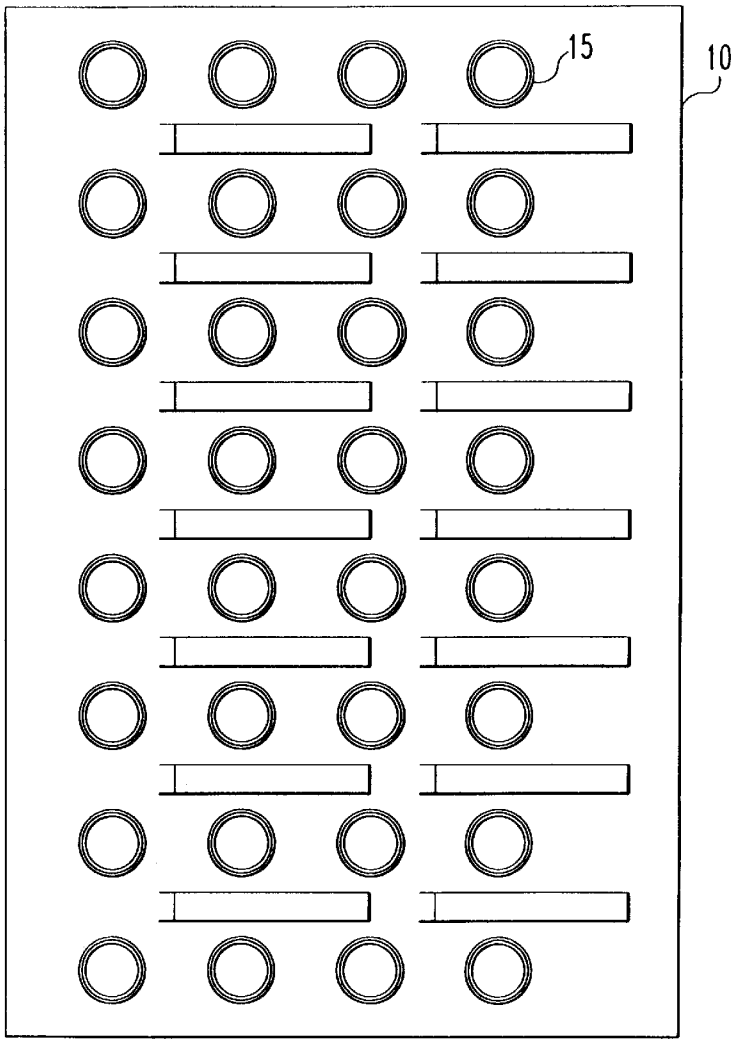
FIG. 1B is a top view of the array of FIG. 1A.
Figure 1A:
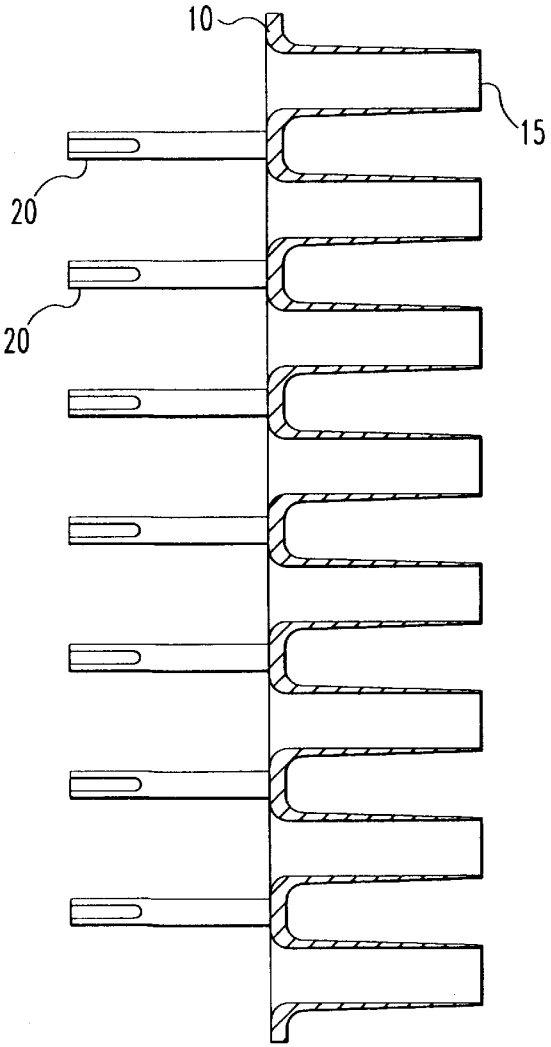
FIG. 1A is a side view of an exemplary conductive plate with an array of drawn barrels and a lanced section in accordance with the present invention.

FIG. 1A is a side view of an exemplary conductive (ground) plate 10 having a series of extruded or drawn barrels 15 and a series of pins or lances 20. The conductive plate 10 preferably comprises an electrically conductive metal. The 20 conductive plate 10 connects to a ground plane (not shown). Each of the drawn barrels 15 is elongated and tubular, and preferably possesses a generally cylindrical configuration. The drawn barrels 15 are hollow throughout their length and are positioned so that the longitudinal axes of all the drawn barrels 15 are parallel to one another. Although the drawn barrels 15 are illustrated as being cylindrical, other shapes are possible.

Preferably, the top surfaces of all of the drawn barrels 15 are disposed in a common plane. Likewise, the lower end surfaces of all of the drawn barrels 15 are coplanar. Also, as illustrated in FIG. 1B, the drawn barrels 15 are disposed in aligned rows and columns so that the center of each drawn barrel 15 in a given row (column) lies along a straight line with respect to a drawn barrel 15 in the immediately adjacent rows (columns).

Each of the pins 20 are preferably essentially flat lanced pins (hereinafter referred to as lances) and are positioned so that the longitudinal axes of all the lances 20 are parallel to one another. Preferably, the top surfaces of all of the lances 20 are disposed in a common plane. Likewise, the lower end surfaces of all of the lances 20 are coplanar. Also, the lances 20 are disposed in aligned rows and columns so that the center of each lance 20 in a given row (column) lies along a straight line with respect to a lance 20 in the immediately adjacent rows (columns).

The preferable pitch of drawn barrels and lances is 2 mm, and preferably a lance is interposed between two adjacently located barrels.

Each of the drawn barrels 15 receive a pin, preferably a signal pin, and each of the lances 20 act as ground connection and are formed of the conductive plate 10 between the drawn barrels 15.

Figure 2B:
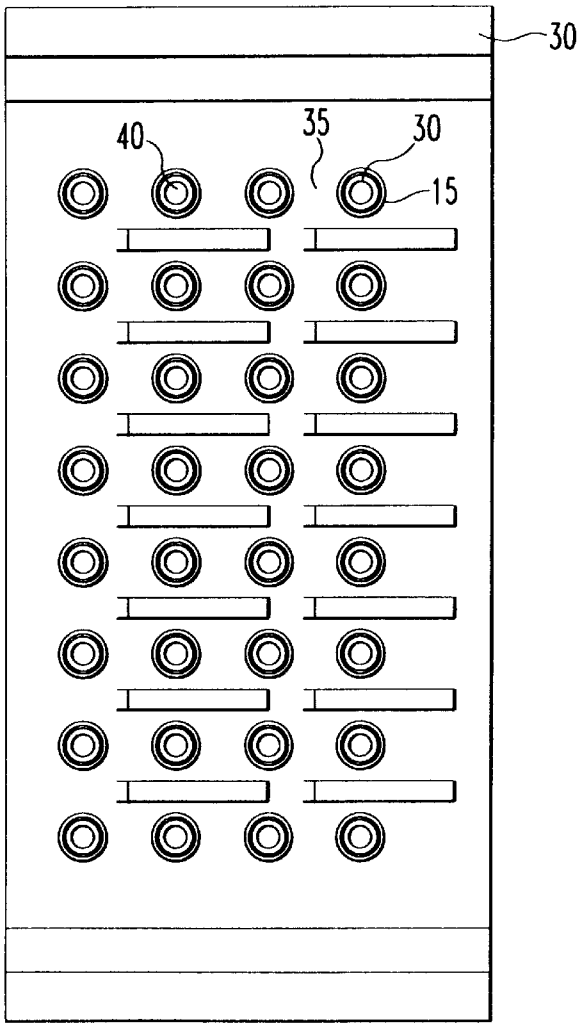
FIG. 2B is a top view of the plate of FIG. 2A.
Figure 2A:
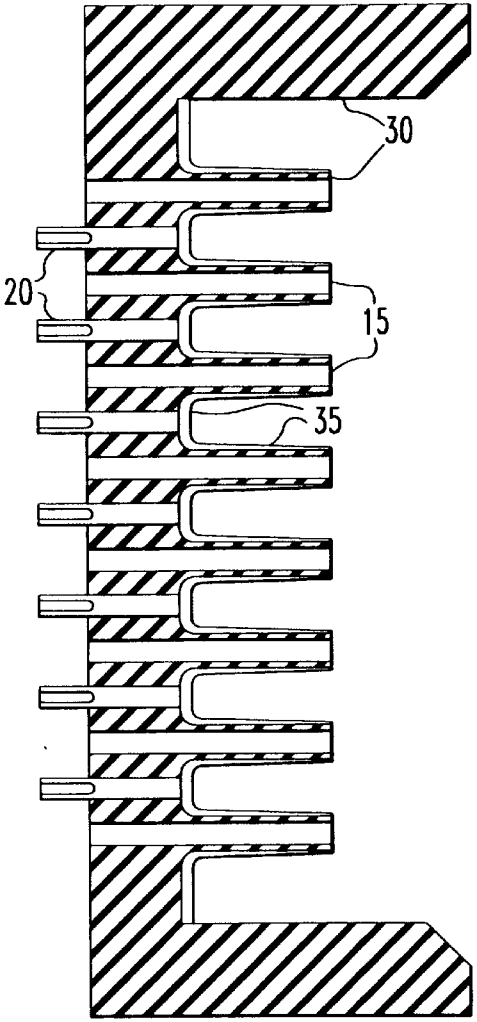
FIG. 2A is a side view of an exemplary plate overmolded with a polymer in accordance with the present invention.

FIGS. 2A and 2B show the exemplary structure of FIGS. 1A and 1B with an overmolding of a polymer. FIGS. 2A and 2B contain elements similar to those described above with respect to FIGS. 1A and 1B. These elements are labeled identically and their description is omitted for brevity.

A polymer overmold 30 is disposed over portions of the conductive plate 10 and on the interior surface (preferably, circumference) of the drawn barrels 15. The polymer overmold 30 effects a coaxial style construction. The overmold 30 acts as an insulator element and electrically and mechanically separates the drawn barrels 15 from the lances 20 (i.e., the signal pins from the ground connection). The lances 20 remain in electrical contact with ground connection portions 35 of the conductive plate 10 on the surface of the conductive plate 10 between the drawn barrels 15.

Figure 3B:
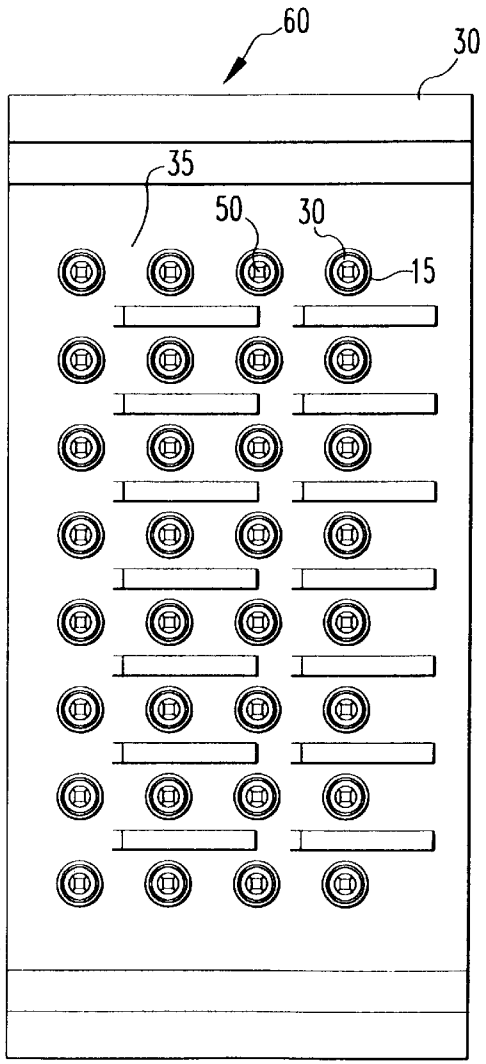
FIG. 3B is a top view of the plate of FIG. 3A.
Figure 3A:
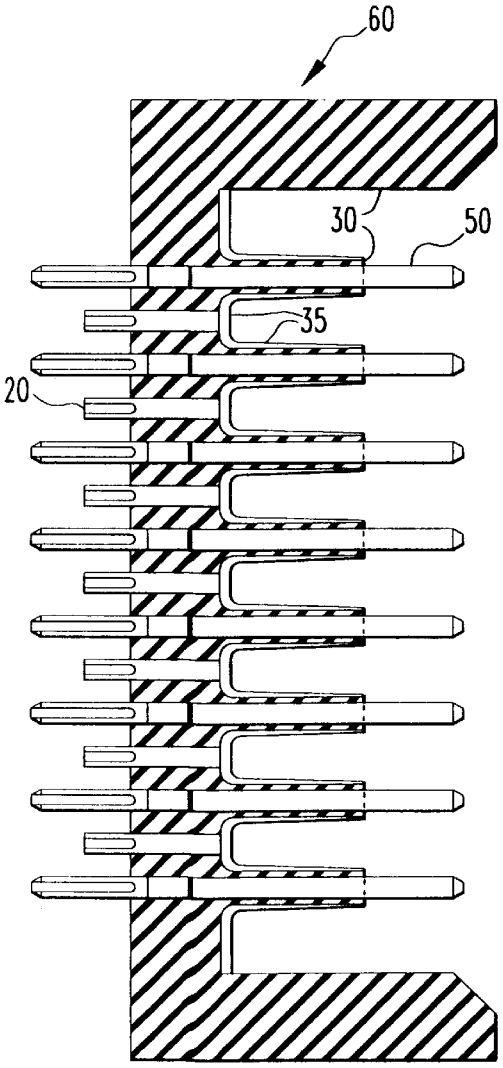
FIG. 3A is a side view of an exemplary plate with installed pins.

As shown in FIG. 2B, the inner circumference of the barrels 15 have the polymer overmold 30. A hollow pinhole 40 remains in the center of each of the drawn barrels 15 to receive a signal pin 50 in each pinhole 40, as shown in FIGS. 3A and 3B. Each signal pin 50 is generally circular and installed in the pinhole 40 in each barrel 15. The polymer 30 provides electrical and mechanical insulation between the signal pin 50 and the ground connection portions 35. The signal pin 50 acts as a contact receiving member. The structure in FIGS. 3A and 3B effect a header connector 60. The header connector 60 can be mounted on or connected to a first printed card, called a motherboard. The header connector 60 can be formed by insert molding in which a housing, acting as the header connector 60, and insulator elements having the pinholes to are formed of a continuous molded material, such as a polymer.

Figure 4A:
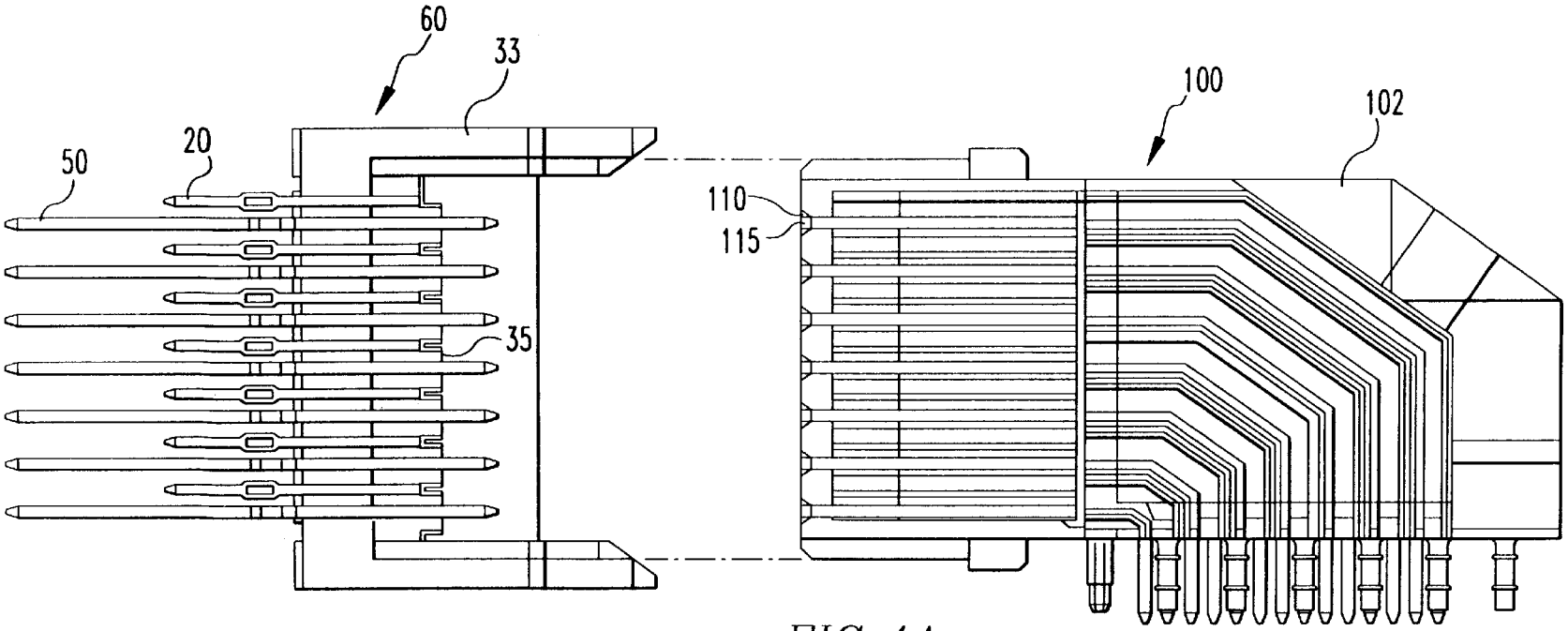
FIG. 4A is a sectional side elevational view of an embodiment of a high speed transmission connector, with the parts separated, according to the present invention.

FIG. 4A is a sectional side elevational view of an embodiment of a high speed transmission connector, with the parts separated, according to the present invention. A straight type of header connector 60 is comprised of a header housing 33 and pins (male contacts) 50 for a signal transmission line and pins (male contacts) 20 for a ground line. These pins 50 and 20 are alternately arranged in a plurality of rows on the header housing 33 of the associated connector 60. The pins are preferably stamped and formed with the preferred material being phosphor bronze or beryllium copper.

A right angle type of socket connector 100 is comprised of a receptacle housing 102, ground receptacle contacts 110 for a ground line, and signal receptacle contacts 115 for a signal transmission line. A plurality of rows of the contacts 110 and 115 are regularly arranged so as to correspond to those of the header connector 60. The housing 102 is preferably molded, using a plastic material such as a high temperature thermoplastic. The contacts are preferably stamped and formed of beryllium copper or phosphor bronze.

The socket connector 100 can be connected to or mounted on a second printed card, called a daughterboard. By bringing the header connector 60 and the socket connector 100 together, the header connector 60 is mated with the socket connector 100, thereby connecting the motherboard to the daughterboard. When mated, the ground contact 110 mates with the ground connection 35 and the signal contact 1 15 mates with the signal pin 50. In other words, the raised surface ground connection 35 engages the ground receptacle contact 10, and the signal pin 50 engages the signal receptacle contact 115 to provide electrical isolation to other signal contacts that are within the connector module in the contact engagement area.

Figure 4B:
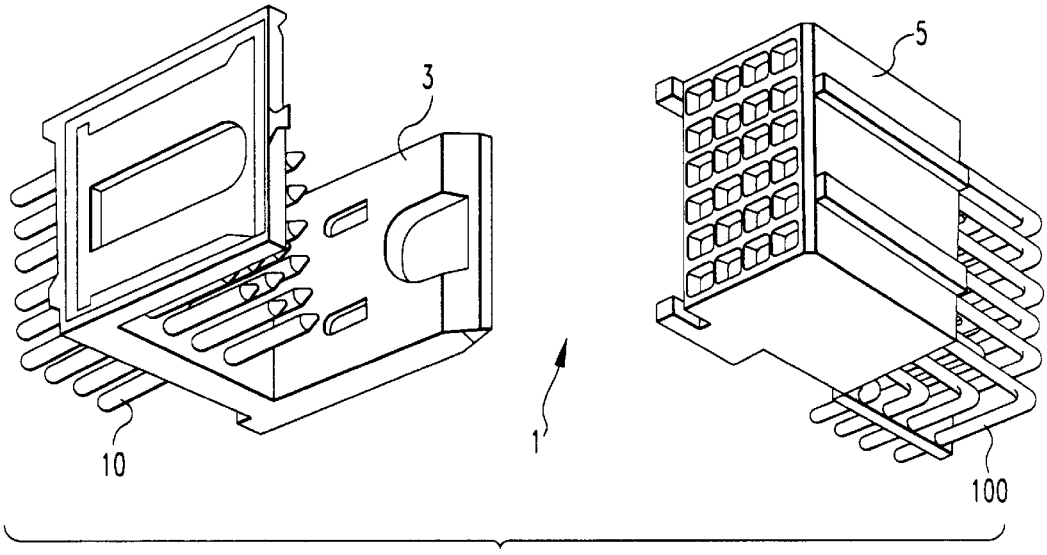
FIG. 4B is a perspective view of an array of a plurality of the connectors of FIG. 4A arranged in a housing, with the parts separated.

A plurality of the connectors of FIG. 4A can be arranged in a housing 1 in an array pattern, as shown in FIG. 4B. The housing 1 is preferably formed of an electrically insulating material and comprises a header housing 3 having an array of header connectors 60, and a socket housing 5 having an array of socket connectors 100.

Figure 4D:
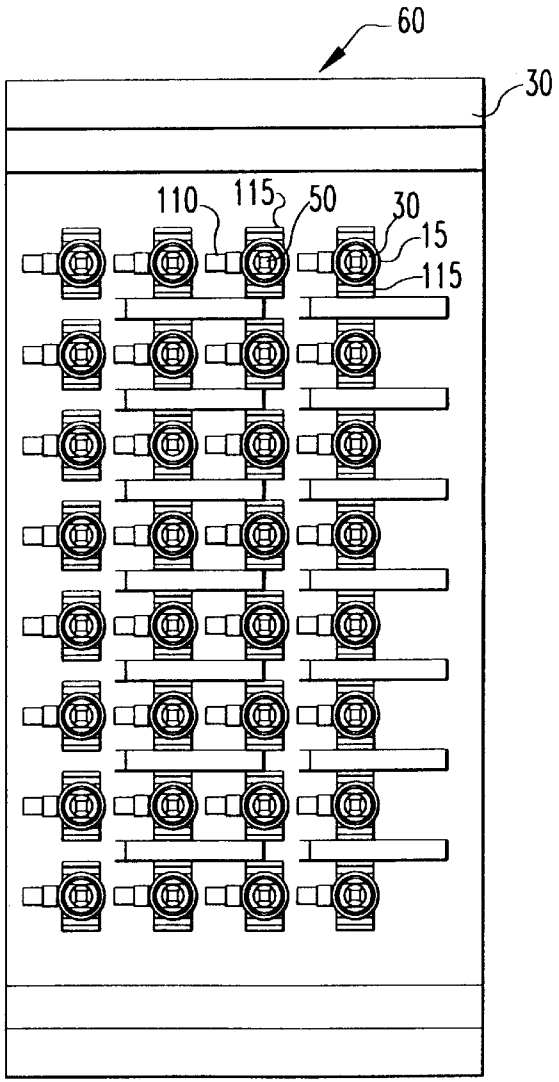
FIG. 4D is a top view of the plate of FIG. 4C.
Figure 4C:
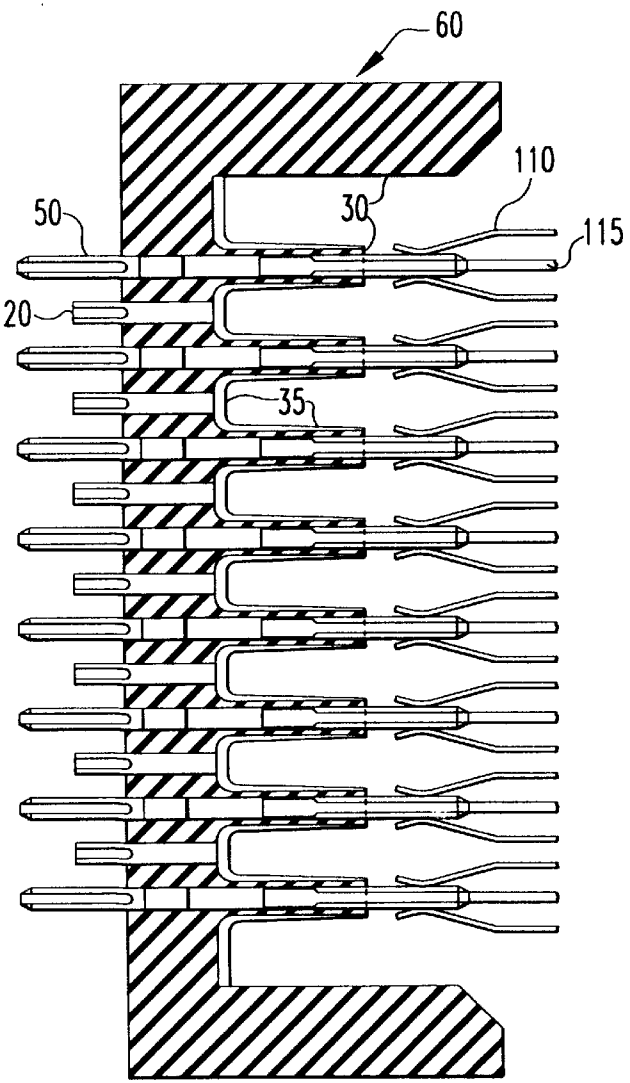
FIG. 4C is a side view of an exemplary plate having dual cantilever beam ground contacts and single cantilever beam signal contacts.

FIG. 4C shows the header connector 60 in contact, but prior to full engagement, with the contacts 110 and 115 of a socket connector. The ground receptacle contacts are preferably a plurality of dual cantilever beam ground contacts 110 and are positioned for mating with respective ground connection portions 35 of the conductive plate. The signal receptacle contacts are preferably a plurality of single cantilever beam signal contacts 115 and are positioned for mating with respective signal pins 50. A top view of this arrangement is shown in FIG. 4D.

Figure 5B:
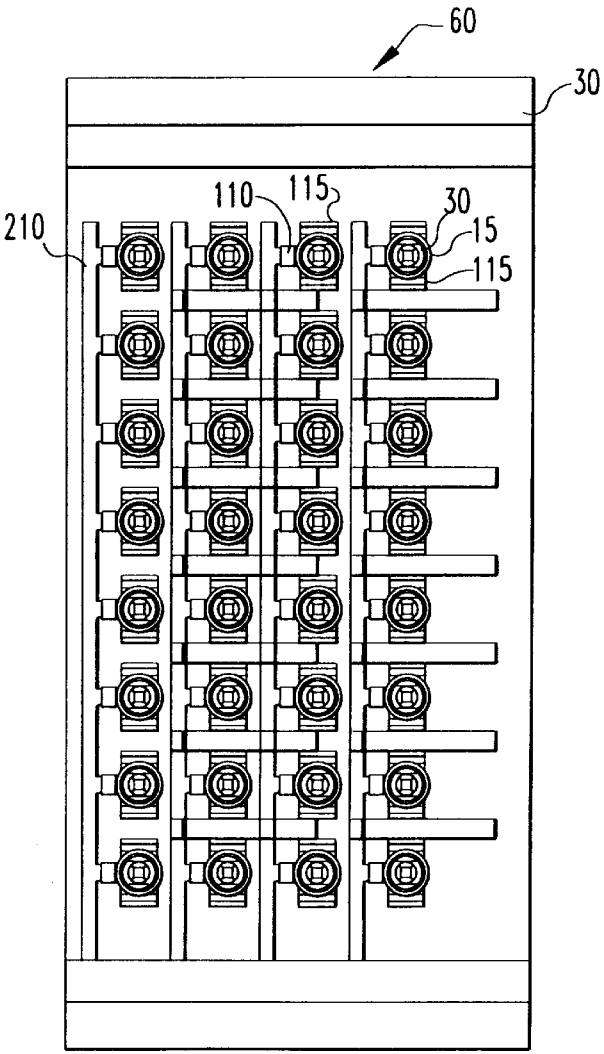
FIG. 5B is a top view showing of the ground plane of FIG. 5A.
Figure 5A:
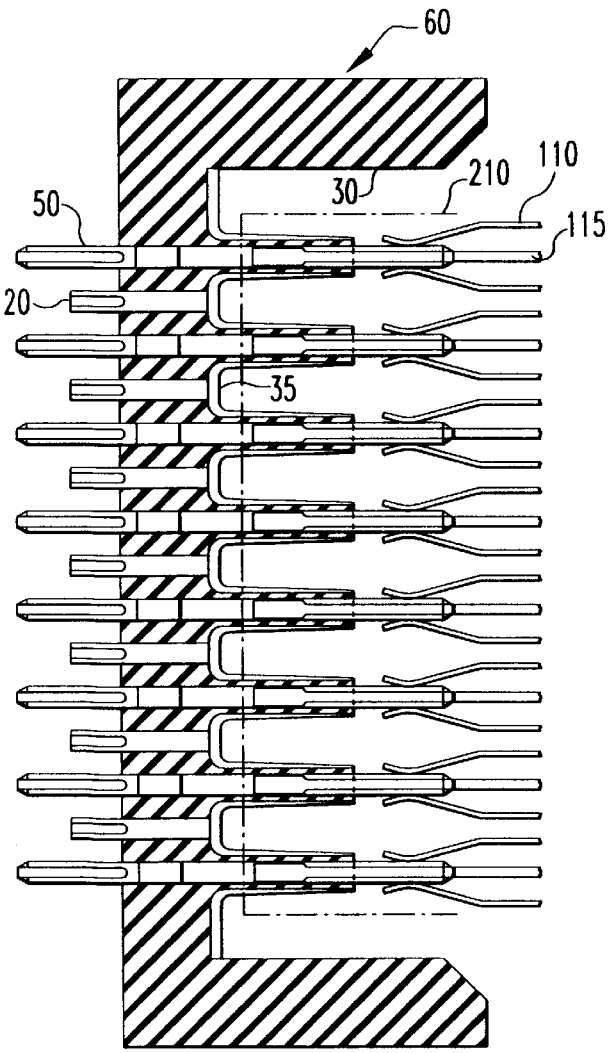
FIG. 5A is a side view of an exemplary a ground plane in accordance with the present invention.
Figure 5C:
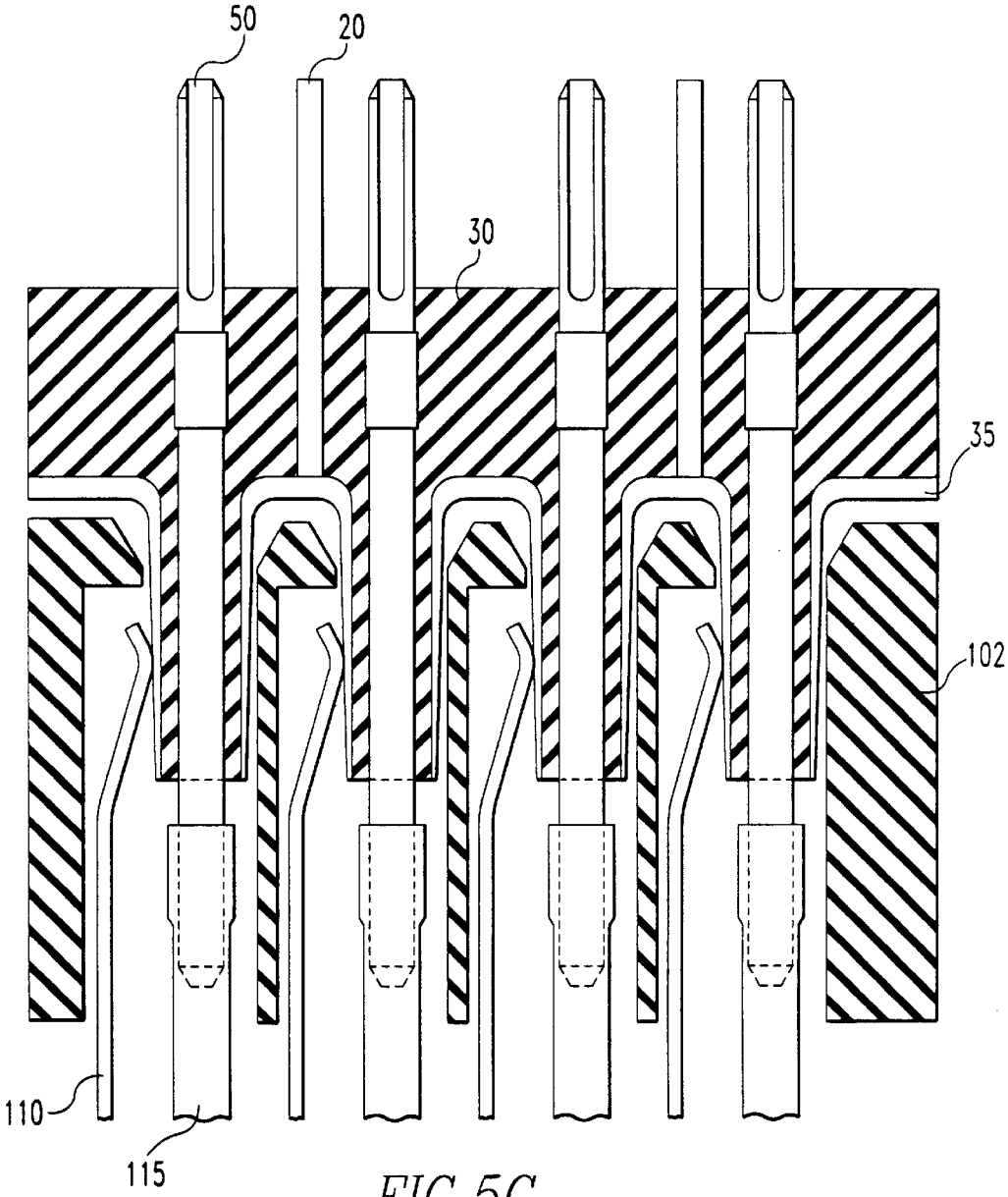
FIG. 5C is a side view of an exemplary mating interface in accordance with the present invention.

FIGS. 5A and 5B are similar to FIGS. 4C and 4D, and include a ground plane 210 mated to the header connector 60. FIG. 5C is a side view of an exemplary mating interface in accordance with the present invention in which the header connector 60 is matingly engaged with the socket connector. The cantilever beam contacts 10 (only one of each pair is shown) of the socket connector housing 102 contact ground connections 35 which are electrically coupled with lances (ground pins) 20. The cantilever beam signal contacts 115 contact signal pins 50. By bringing the header connector 60 and the socket connector together, the header connector 60 is mated with the socket connector, thereby connecting the motherboard to the daughterboard.

Figure 6B:
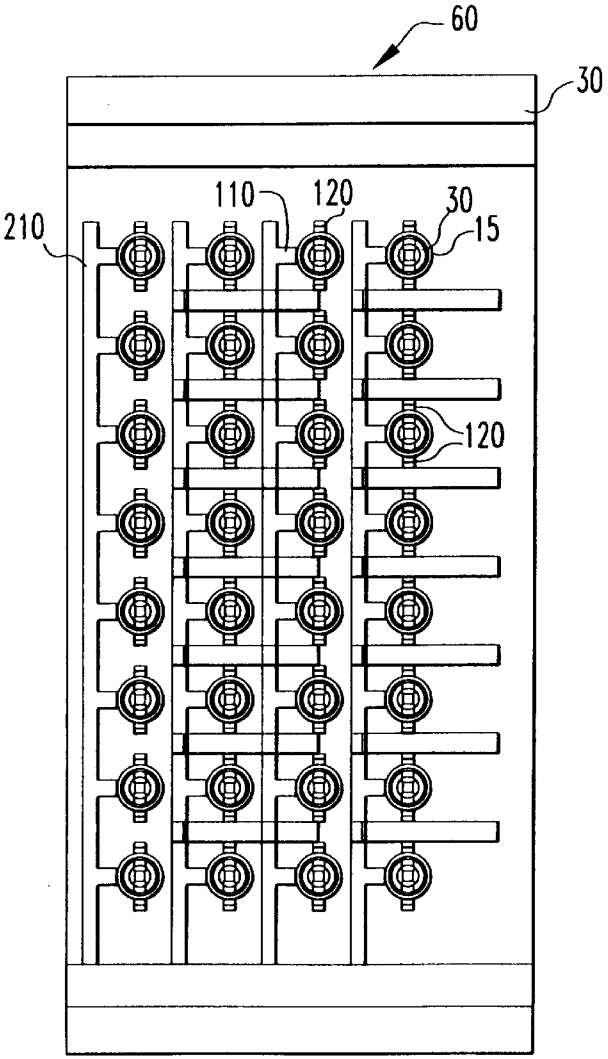
FIG. 6B is a top view of the ground plane and tuning fork style contacts of FIG. 6A.
Figure 6A:
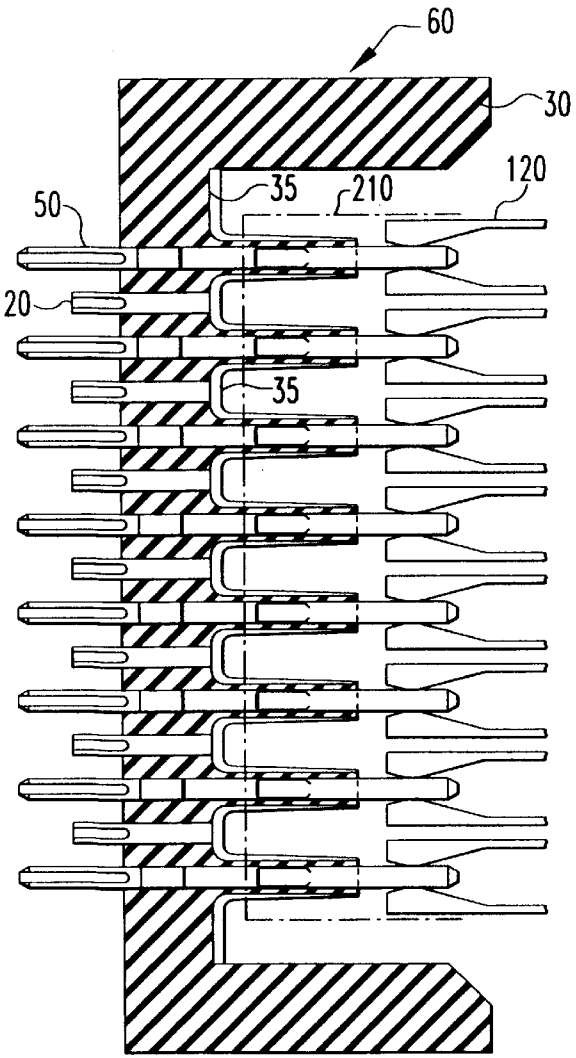
FIG. 6A is a side view of an exemplary ground plane mated to a coaxial header with tuning fork style signal contacts in accordance with the present invention.
Figure 6C:
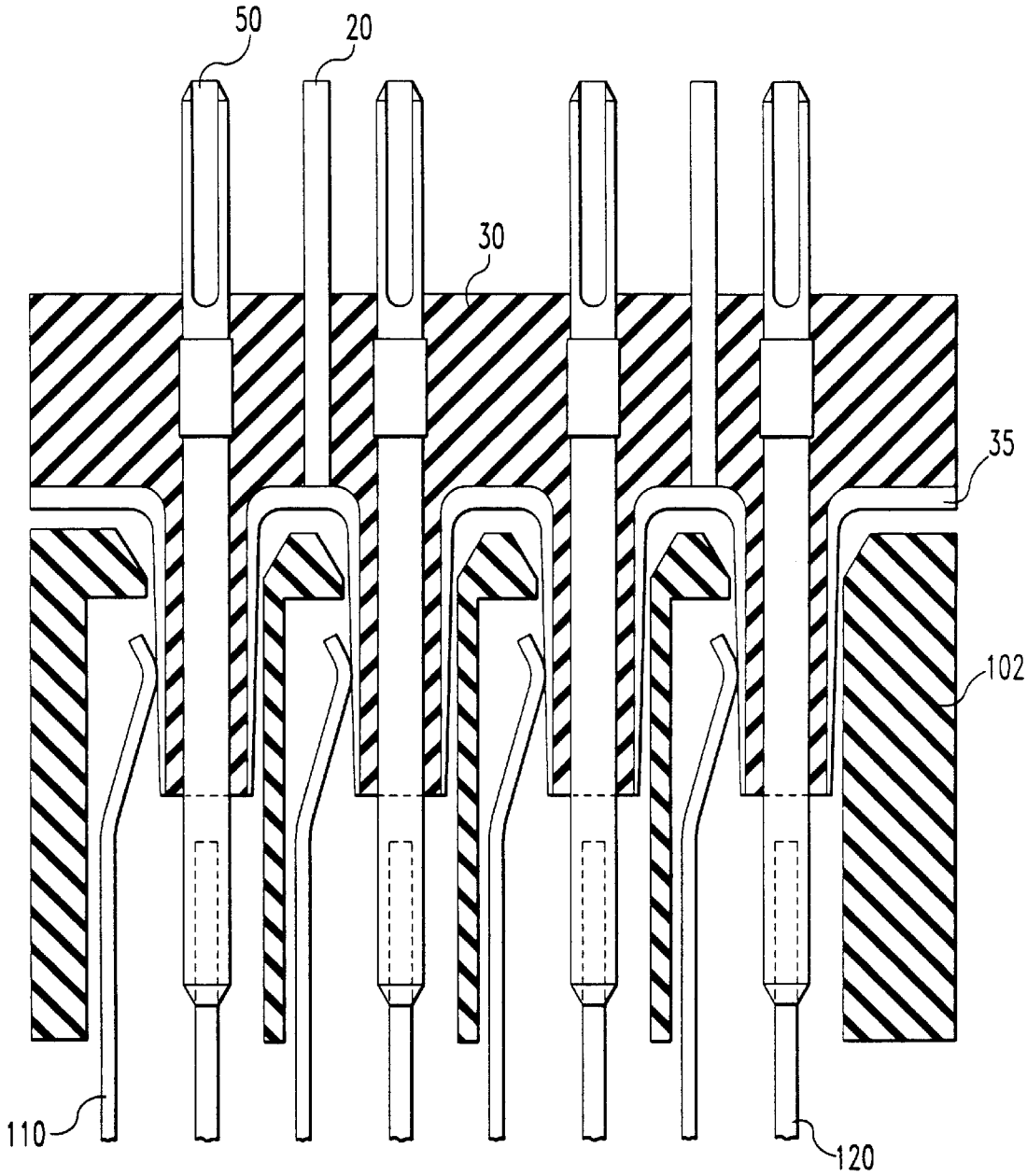
FIG. 6C is a side view of a further exemplary mating interface in accordance with the present invention.

FIGS. 6A through 6C show another exemplary connector in accordance with the present invention. FIGS. 6A through 6C are similar to FIGS. 5A through 5C, but tuning fork style signal contacts 120 are used as signal contacts instead of cantilever beam signal contacts 115.

Figure 7B:
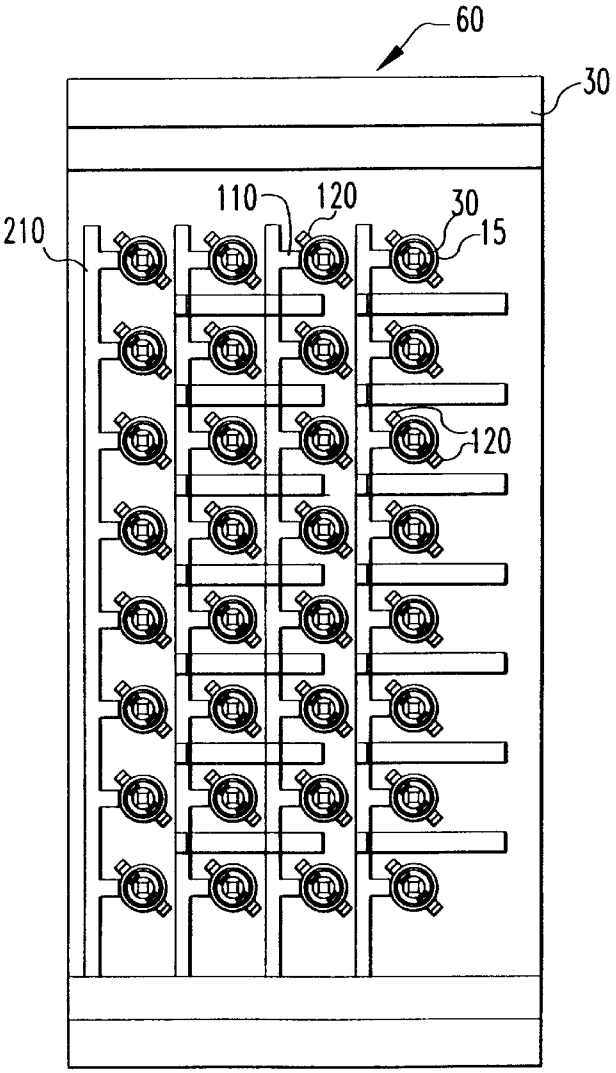
FIG. 7B is a top view of the exemplary ground plane of FIG. 7A.
Figure 7A:
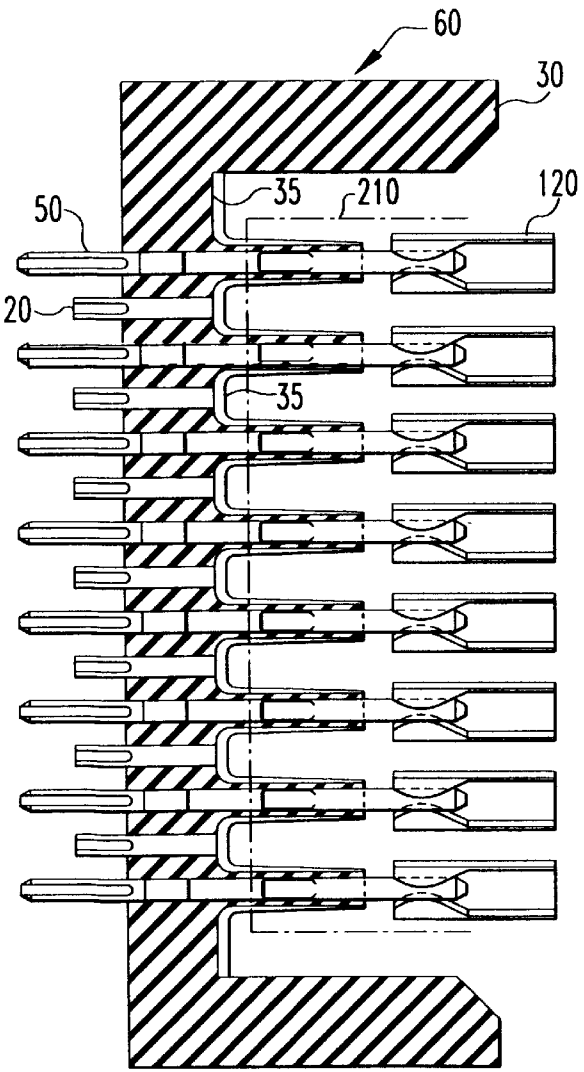
FIG. 7A is a side view of an exemplary ground plane having a tuning fork interface that is rotated 45 degrees.
Figure 7C:
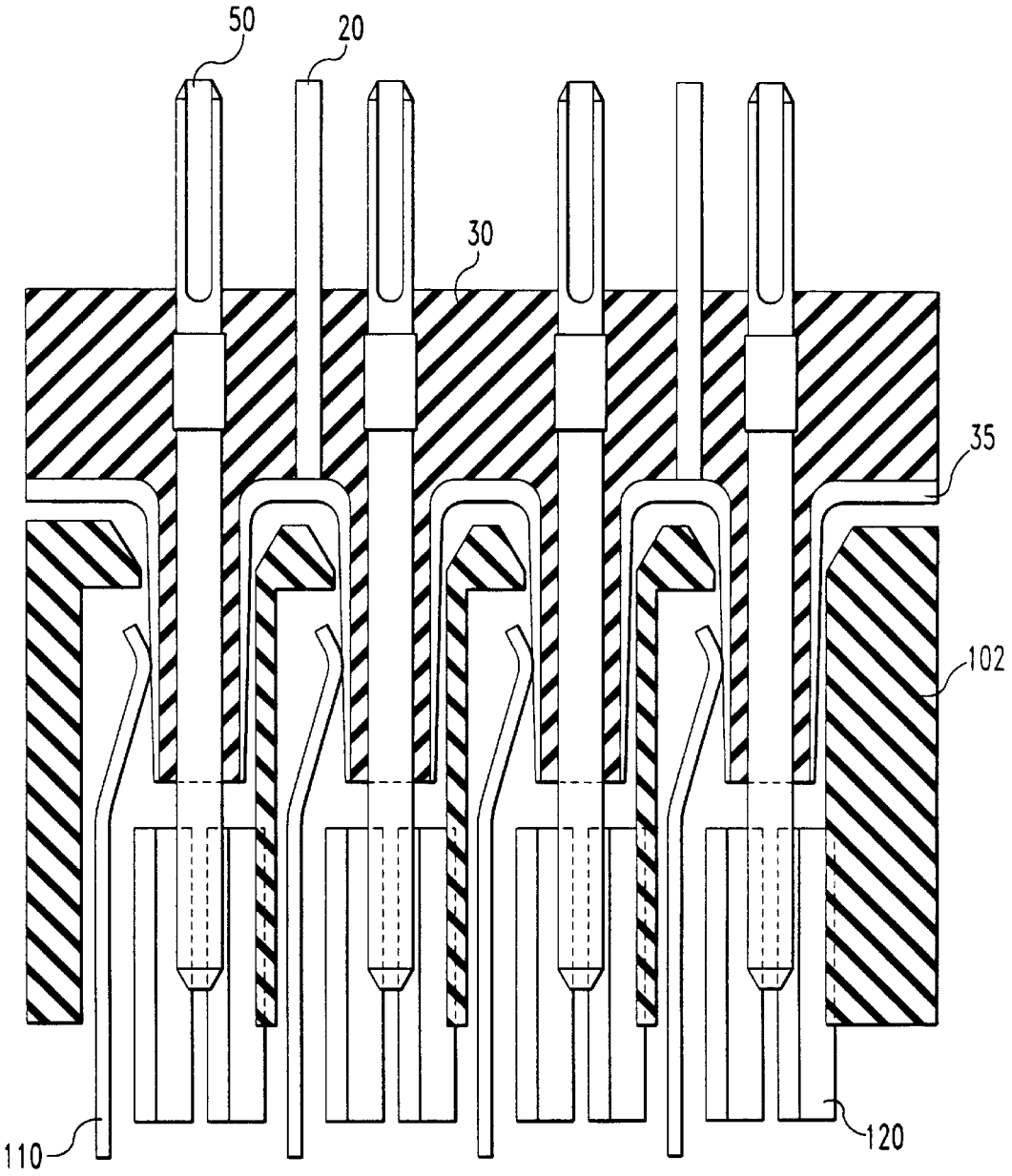
FIG. 7C is a side view of a further exemplary mating interface in accordance with the present invention.

FIGS. 7A through 7C show another exemplary connector in accordance with the present invention. FIGS. 7A through 7C are similar to FIGS. 6A through 6C, but the tuning fork style signal contacts 120 are rotated approximately 45 degrees in a clockwise or counterclockwise direction around the signal pins 50. This rotation increases the distance between signals and brings the signals closer to the ground plane, for increased signal integrity.

Figure 8:
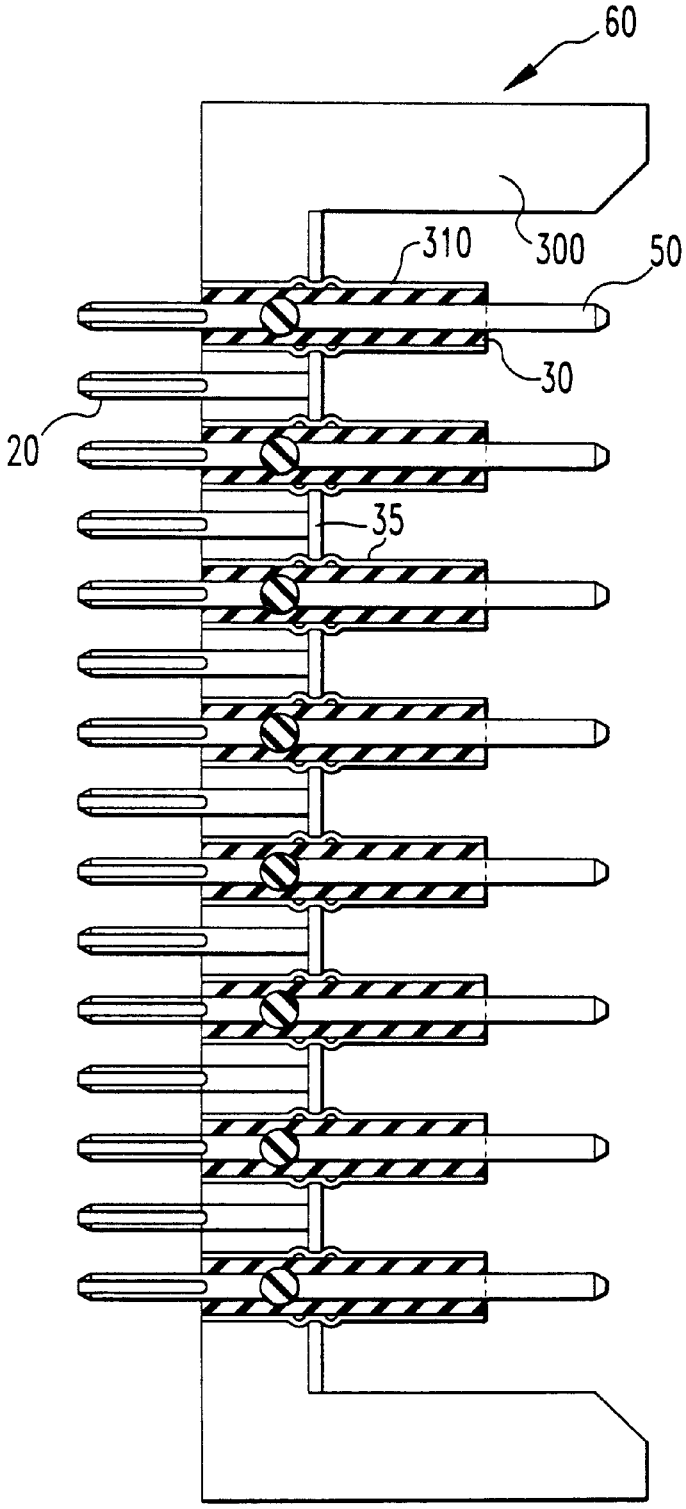
FIG. 8 is a side view of an exemplary perforated plate and individual drawn cylinders in accordance with the present invention.

FIG. 8 is a side view of an exemplary perforated plate and individual cylinders 310, preferably metal, in accordance with the present invention. FIG. 8 is similar to FIG. 3A except an extruded conductive plate is not used. Instead, a perforated plate 300 is used. Individual cylinders 310 are formed to receive the signal pins 50. The cylinders 310 can be drawn, rolled, or cut. A polymer overmold 30 is inserted in the cylinders 310 to separate the signal pins 50 from the ground connections 35. The embodiment of FIG. 8 is used to extend the ground bus all the way through the header connector to a backplane. The cylinders are attached to the plate by soldering, welding, press-fitting, or swaging.

It should be noted that although the socket connector of the illustrated embodiments is provided with right angle portion, the present invention is not limited thereto. For example, the present invention can be applied to a socket connector (not shown) having a straight type ground contact and a straight type signal contact, without a right angle portion.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. A connector comprising:

a conductive ground plate having first and second faces, a plurality of first protrusions protruding from said first face, and a plurality of second protrusions protruding from said second face, said second protrusions being hollow and forming respective raised ground surfaces;

a plurality of insulator elements, each being disposed against the inner surface of said second protrusions and having a pinhole; and a plurality of signal pins, one signal pin extending through each of said pinholes in said insulator elements and through said conductive ground plate and separated from said conductive ground plate by said insulator elements, and each ground surface surrounding a respective insulator element and signal pin, wherein each respective first protrusion is interposed between two adjacent second protrusions.

2. The connector of claim 1, wherein said second protrusions are substantially cylindrical.

3. The connector of claim 1, wherein said second protrusions are drawn.

4. The connector of claim 1, wherein each of said second protrusions have a top surface and a lower surface, said top surfaces being disposed in a first common plane, and said lower surfaces being disposed in a second common plane.

5. The connector of claim 1, wherein said first protrusions are substantially flat lanced pins.

6. The connector of claim 1, wherein the longitudinal axes of each of said first protrusions are parallel to one another.

7. The connector of claim 1, wherein each of said first protrusions have a top surface and a lower surface, said top surfaces being coplanar, and said lower surfaces being coplanar.

8. The connector of claim 1, wherein the conductive ground plate comprises an electrically conductive metal.

9. The connector of claim 1, wherein each of said insulator elements is a polymer.

10. The connector of claim 1, wherein said conductive ground plate is extruded.

11. The connector of claim 1, wherein said conductive ground plate is perforated.

12. A connector system for mounting to a circuit substrate comprising:

a housing; and a connector module supported by said housing, said connector module including:

a conductive ground plate having first and second faces, a plurality of first protrusions protruding from said first face, and a plurality of second protrusions protruding from said second face, said second protrusions being hollow and forming a raised ground surface;

a plurality of insulator elements, each respective insulator element having a pinhole and being disposed against the inner surface of each of said second protrusions; and a plurality of signal pins, one of said signal pins extending through respective ones of said pinholes in said insulator elements and through said conductive ground plate and separated from said conductive ground plate by said insulator elements, and one of said raised ground surfaces surrounding respective insulator elements and signal pins; and a plurality of socket connectors, each having a plurality of signal receptacle contacts and a plurality of ground receptacle contacts, so that, in mated condition, each respective signal contact mechanically connects and electrically contacts with each respective signal pin, and each of said ground contacts mechanically connects and electrically contacts with respective raised ground surfaces, wherein each respective first protrusion is interposed between two adjacent second protrusions.

13. The connector system of claim 12, wherein each of said socket connectors further comprises a receptacle housing, and wherein each said socket connector is a right angle type of socket connector, each said signal receptacle contact is a single cantilevered signal receptacle contact, and each said ground receptacle contact is a dual cantilevered ground receptacle contact.

14. The connector system of claim 12, wherein each of said socket connectors further comprises a receptacle housing, and wherein each said socket connector is a right angle type of socket connector, each said signal receptacle contact is a tuning fork style signal contact, and each said ground receptacle contact is a dual cantilevered ground receptacle contact.

15. The connector system of claim 14, wherein each said tuning fork style signal contact is rotated 45 degrees around a respective signal pin.

16. The connector system of claim 12, wherein said conductive ground plate is extruded.

17. The connector system of claim 12, wherein said conductive ground plate is perforated.

18. The connector of claim 12, wherein said housing and insulator elements having said pinholes are formed of a continuous molded material.

19. A header body, comprising:

a generally planar, conductive base having a first surface and an opposed second surface;

a plurality of openings extending through said base from said first surface to said second surface of said base;

a plurality of projections extending from said first surface of said base, each projection surrounding a corresponding opening; and a plurality of holes in said second surface of said base and located between adjacent openings.

20. The header body as recited in claim 19, in combination with a plurality of insulative inserts, each insert disposed within corresponding openings and projections and having a pinhole therein.

21. The header body as recited in claim 20, in combination with a plurality of pins, each pin disposed within a corresponding pinhole.

22. The header body as recited in claim 19, further comprising a pair of walls extending from opposite edges of said base.

23. The header body as recited in claim 19, wherein said plurality of holes have a bottom surface disposed within said base.

24. The header body as recited in claim 19, wherein said plurality of holes extend through said base.

25. A connector system for mounting to a circuit substrate comprising:

a housing; and a connector module supported by said housing, said connector module including:

a conductive ground plate having first and second faces, a plurality of first protrusions protruding from said first face, and a plurality of second protrusions protruding from said second face, said second protrusions being hollow and forming a raised ground surface;

a plurality of insulator elements, each respective insulator element having a pinhole and being disposed against the inner surface of each of said second protrusions; and a plurality of signal pins, one of said signal pins extending through respective ones of said pinholes in said insulator elements and through said conductive ground plate and separated from said conductive ground plate by said insulator elements, and one of said raised ground surfaces surrounding respective insulator elements and signal pins; and a plurality of socket connectors, each having a plurality of signal receptacle contacts and a plurality of ground receptacle contacts, so that, in mated condition, each respective signal contact mechanically connects and electrically contacts with each respective signal pin, and each of said ground contacts mechanically connects and electrically contacts with respective raised ground surfaces, wherein each of said socket connectors further comprises a receptacle housing, and wherein each said socket connector is a right angle type of socket connector. each said signal receptacle contact is a tuning fork style signal contact, and each said ground receptacle contact is a dual cantilevered ground receptacle contact.

26. The connector system as recited in claim 25, wherein each said tuning fork style signal contact is rotated 45 degrees around a respective signal pin.

* * * * *